United States Patent [19]

Pachmayr et al.

[11] 4,397,109

[45] Aug. 9, 1983

[54] STRUCTURE AND MOUNTING OF GUN CARTRIDGE CLIP PADS

[75] Inventors: Frank A. Pachmayr; Jack R. Farrar, both of Los Angeles, Calif.

[73] Assignee: Pachmayr Gun Works, Inc., Los Angeles, Calif.

[21] Appl. No.: 231,382

[22] Filed: Feb. 4, 1981

[51] Int. Cl.[3] ..... F41C 25/02

[52] U.S. Cl. ..... 42/50

[58] Field of Search ..... 42/7, 50, 6, 71 P

[56] References Cited

U.S. PATENT DOCUMENTS

| | | | |
|---|---|---|---|
| 580,926 | 4/1897 | Browning | 42/7 |
| 2,510,831 | 6/1980 | Patchett | 42/50 |
| 2,828,568 | 4/1958 | Sakewitz | 42/7 |
| 2,903,809 | 9/1959 | Stoner | 42/50 |
| 3,160,976 | 12/1964 | Pachmayr | 42/74 |
| 3,263,359 | 8/1966 | Pachmayr | 42/74 |
| 3,363,352 | 1/1968 | Pachmayr | 42/74 |
| 3,372,506 | 3/1968 | Wilhelm | 42/7 |
| 3,672,084 | 6/1972 | Pachmayr | 42/71 P |
| 3,815,270 | 6/1974 | Pachmayr | 42/71 P |
| 4,043,066 | 8/1977 | Pachmayr et al. | 42/71 P |
| 4,132,024 | 1/1979 | Pachmayr et al. | 42/71 P |
| 4,148,149 | 4/1979 | Pachmayr et al. | 42/71 P |
| 4,162,586 | 7/1979 | Pachmayr | 42/71 P |
| 4,328,633 | 5/1982 | Pachmayr et al. | 42/71 P |

*Primary Examiner*—Charles T. Jordan

*Attorney, Agent, or Firm*—William P. Green

[57] ABSTRACT

A cushioning pad adapted to be connected to the lower end of a gun cartridge clip and including a body of elastomeric material to be engaged by a user's hand in pressing the clip upwardly into the handle of the gun, and a reinforcing plate embedded within the elastomeric material and through which screws extend upwardly for connection into the bottom wall of the clip body, with the screws having heads applying upward force to the reinforcing element in a manner securing the pad on the clip. If the clip is of a type having a horizontally slidably removable bottom wall, the pad may be secured to that wall and contain a passage through which a tool is insertable upwardly to a position for engaging and releasing a latch element normally holding the bottom wall against detaching movement.

19 Claims, 13 Drawing Figures

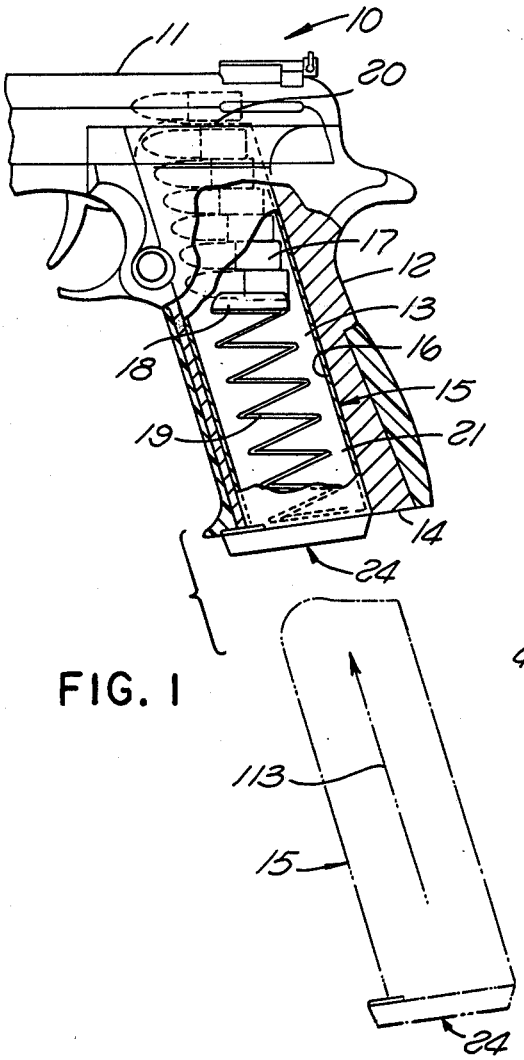
FIG. 1
FIG. 2
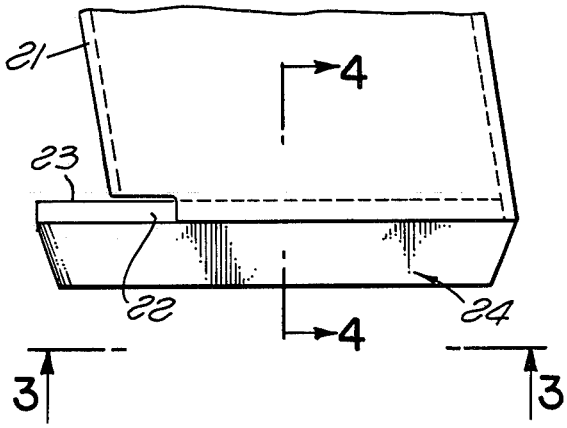
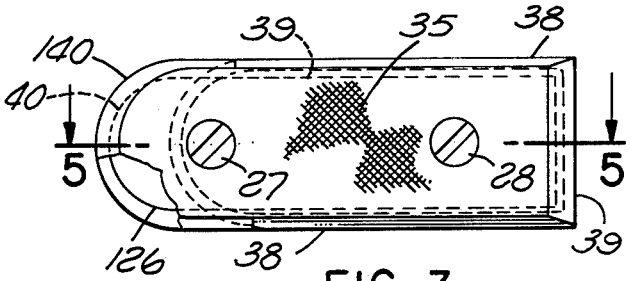
FIG. 3
FIG. 5
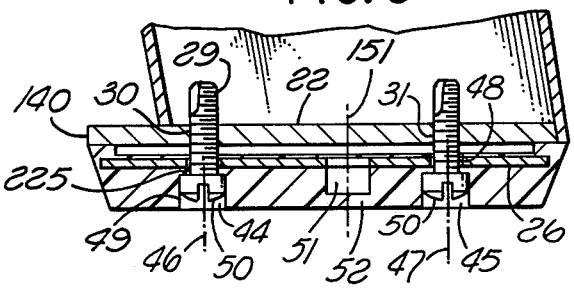
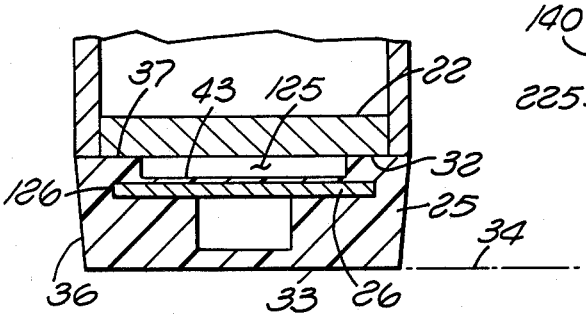
FIG. 4
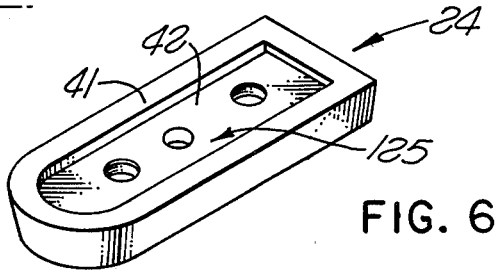
FIG. 6

FIG. 7
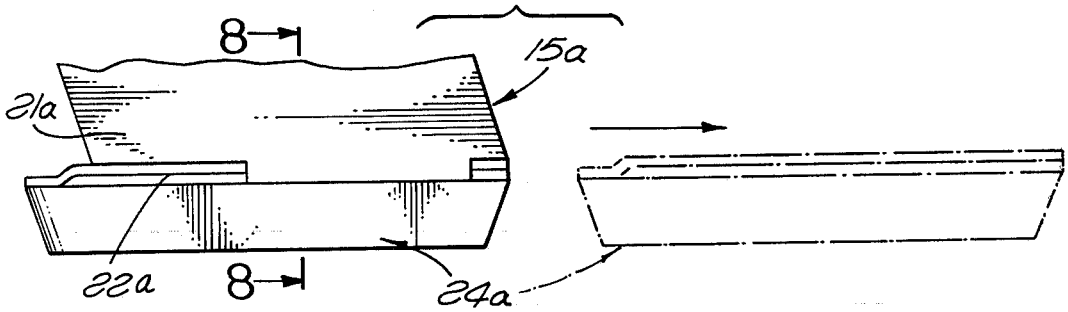
FIG. 8
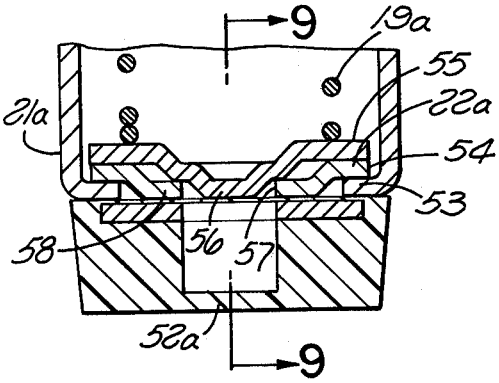
FIG. 11
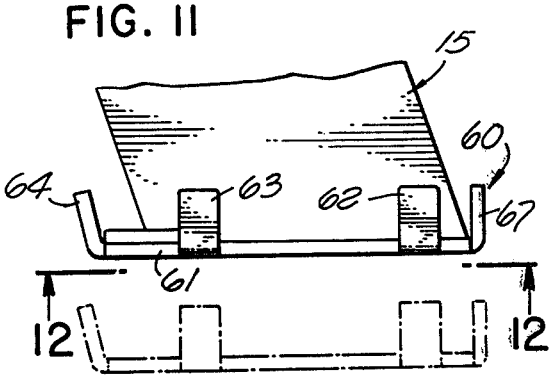
FIG. 9
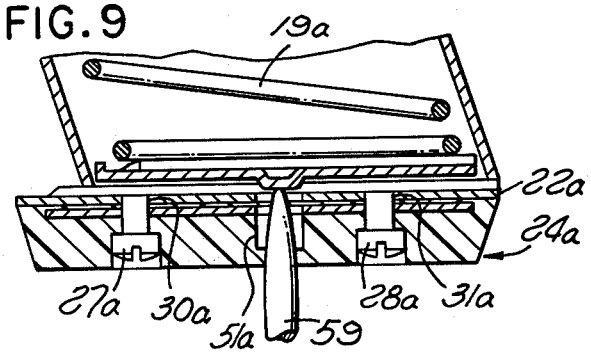
FIG. 12
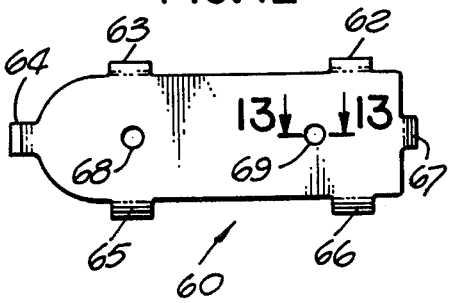
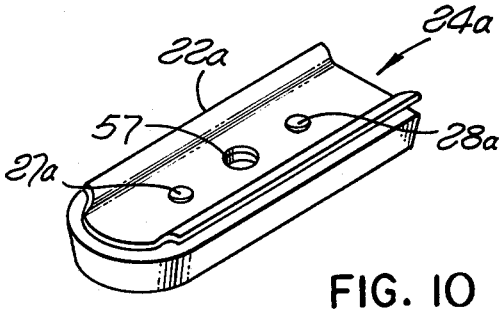
FIG. 10
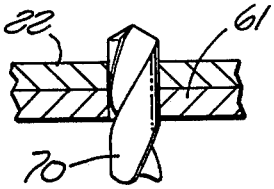
FIG. 13

STRUCTURE AND MOUNTING OF GUN CARTRIDGE CLIP PADS

BACKGROUND OF THE INVENTION

This invention relates to improved cushioning pads for use in conjunction with a cartridge clip which holds a series of rounds of ammunition in a gun.

The pads of the present invention are usable with guns of a type in which the handle of the gun contains a downwardly opening recess within which there is receivable a clip containing a series of rounds of ammunition which are fed successively upwardly to the firing mechanism of the gun. In loading the gun, the cartridge clip is pressed upwardly into the handle of the gun by force exerted against the lower end of the clip. In order to cushion the engagement between a user's hand and the clip during such insertion of the clip into a gun, cushions of rubber have been provided for attachment to the lower end of the clip, and have been connected to the bottom wall of the clip by adhesive. However, after repeated handling this adhesive connection between the rubber cushion and the metal of the clip often permits the rubber to separate from the metal at one or more locations and may ultimately allow complete separation of the pad from the clip body.

The bottom wall of the clip is in some instances rigidly secured in fixed position relative to the main upper cartridge containing portion of the clip. In other instances, the bottom wall of the clip body is mounted slidably to the remainder of the the clip for horizontal detachment therefrom. In a clip structure utilizing this latter removable type bottom wall, the cementing of a rubber cushion of the previously utilized type to the underside of that wall may prevent detachment of that wall from the clip by blocking access to a latch element which must be released to permit such removal.

SUMMARY OF THE INVENTION

The present invention provides an improved clip pad which is secured on the lower end of a clip much more effectively than the above discussed previously proposed adhesive mounted devices, and which can remain on the clip permanently and without danger of accidental displacement from the clip as a result of handling and use. The device can be employed on a clip having either a rigidly mounted bottom wall or a slidably detachable bottom wall, and in the latter case the pad can remain attached to the bottom wall during separation from the remainder of the clip and without interfering with manual release of the mentioned latching element which retains the bottom wall against its separating movement. This latch releasing capability may be attained by providing the cushioning pad with an opening through which a tool is insertable upwardly to a position of engagement with the latch element to press it upwardly out of a latching opening in the removable bottom wall of the clip and thereby permit horizontal shifting movement of that bottom wall.

A pad embodying the invention preferably includes a body of resiliently deformable elastomeric material which is received at the underside of the bottom wall of the clip and which has an undersurface formed of that elastomeric material exposed for contact with a user's hand in pressing the clip upwardly. In addition, the pad includes a reinforcing element which is formed of a material stiffer than the elastomeric material and is preferably embedded therein and is located above the level of the mentioned undersurface of the elastomeric body. This reinforcing element contains one or more openings through which a fastener or fasteners extend upwardly for threaded attachment to the bottom wall of the clip, with these fasteners having heads acting to apply upward force to the reinforcing element in a manner positively securing the pad to the bottom wall of the clip and in fixed relation relative thereto. The elastomeric body preferably contains a shallow recess at its upper side and has a portion extending about and defining that recess and which may bear upwardly against the bottom wall of the clip along a portion or all of its periphery.

BRIEF DESCRIPTION OF THE DRAWINGS

The above and other features and objects of the invention will be better understood from the following detailed description of the typical embodiments illustrated in the accompanying drawings in which:

FIG. 1 is a fragmentary side view of an automatic pistol with the handle of the pistol partially broken-away in section to illustrate a cartridge clip having a pad constructed in accordance with the invention;

FIG. 2 is an enlarged fragmentary side view of the lower portion of the clip and pad of FIG. 1, with the pad shown in a directly horizontally extending condition to simplify this and other views of the drawings;

FIG. 3 is a bottom plan view taken on line 3—3 of FIG. 2;

FIG. 4 is a transverse vertical section taken on line 4—4 of FIG. 2;

FIG. 5 is a front to rear vertical section taken on line 5—5 of FIG. 3;

FIG. 6 is a perspective representation of the pad of FIGS. 1 through 5;

FIG. 7 is a view similar to FIG. 2 but showing a variational form of clip having a removable bottom wall;

FIG. 8 is a transverse vertical section taken on line 8—8 of FIG. 7;

FIG. 9 is a front to rear vertical section taken on line 9—9 of FIG. 8;

FIG. 10 is a perspective view of the device of FIGS. 7 through 9;

FIG. 11 illustrates the manner in which a special jig is utilized for drilling the pad mounting holes in the bottom wall of either of the two types of clips;

FIG. 12 is bottom plan view taken on line 12—12 of FIG. 11; and

FIG. 13 is an enlarged fragmentary vertical section taken on line 13—13 of FIG. 12.

DESCRIPTION OF THE PREFERRED EMBODIMENTS

The gun 10 which is illustrated fragmentarily in FIG. 1 has a frame 11 with a handle portion 12 containing a recess 13 extending upwardly into the handle from its lower end 14 and within which an ammunition clip 15 is received. The clip is insertable upwardly into recess 13 along an inclined axis 113 from the broken line position of FIG. 1 to the full line position of that figure, and is removable downwardly from the recess for reloading.

Clip 15 includes a somewhat elongated hollow clip body 16 within which a series of rounds of ammunition 17 are received in parallel relation. An element 18 engages the lower one of the rounds of ammunition and is yieldingly urged upwardly by a spring 19 to feed the rounds successively through the upper open end 20 of the clip body to the firing mechanism of the gun.

The clip body 16 is of conventional construction, including a part 21 which is generally tubular about axis 113 but deformed to a horizontal cross section corresponding to that of the ammunition rounds to closely confine them as they are advanced upwardly. The lower end of part 21 is closed by a horizontal bottom wall 22 which may have a forward portion 23 projecting forwardly beyond the front of tubular part 21. Both of these elements 21 and 22 may be formed of metal, with the bottom wall being secured rigidly to part 21 in appropriate manner as by welding them together along the bottom edge of part 21.

The cushioning pad of the present invention is illustrated at 24 in FIGS. 1 through 6, and includes a body 25 of resiliently deformable elastomeric material and a reinforcing plate 26 embedded within and stiffer than the elastomeric material of body 25. Pad 24 is secured to the underside of bottom wall 22 of clip body 16 by two screws 27 and 28 extending upwardly through the pad and having their threaded shanks 29 connected into two spaced openings 30 and 31 in bottom wall 22. Openings 30 and 31 may initially be drilled as unthreaded circular holes, with the threads of screws 27 and 28 being self-tapping in character to automatically tap internal threads within those openings and thereby form an effective threaded connection between the screws and bottom wall 22 of the clip body.

Bottom wall 22 of the clip may extend approximately horizontally in the FIG. 1 normal position of use of the gun, and has a planar undersurface 32. The elastomeric body 25 of pad 24 may be formed of Neoprene or other rubber having sufficient deformability to effectively cushion the engagement between a user's hand and the pad when the user presses the clip upwardly into the gun handle. For example, the elastomeric material of body 25 may typically have a Shore hardness between about 35 and 60 on the A scale. The undersurface 33 of body 25 is generally planar and approximately horizontal in the FIG. 1 position of the gun, lying essentially in the plane 34 of FIG. 4, and may be checkered or otherwise irregularized as illustrated at 35 in FIG. 3. A peripheral side surface 36 of body 25 extends generally vertically from the plane of undersurface 33 to the plane of an upper surface 37 of body 25, and may have the outline configuration illustrated in FIG. 3 giving the pad an approximately rectangular shape as seen in that figure, defined by two generally parallel opposite side edges 38, a rear transverse edge 39, and a rounded front portion 40 of the pad body. Along all of these edges 38 through 40, the peripheral side surface 36 of body 25 may be inclined to advance slightly laterally inwardly as it advances downwardly, so that the lower extremity of body 25 at the level of undersurface 33 is slightly smaller than the upper portion of that body at the level of top surface 37.

Reinforcing plate 26 may be formed of a suitable metal, such as steel, having a stiffness substantially greater than elastomeric body 25 to assist in maintaining that body against excessive deformation. Plate 26 may be planar and disposed directly parallel to the upper and lower planar surfaces 37 and 33 of body 25. Plate 26 is at a level spaced a substantial distance above the plane 34 of the undersurface 33 of body 25 and preferably beneath the plane of upper surface 37 of body 25. The peripheral edge 126 of plate 26, as represented in broken lines in FIG. 3, may follow essentially the outline configuration of the peripheral side surface 36 of body 25, but be spaced inwardly a short distance therefrom.

The top of body 25 contains a shallow recess 125 above reinforcing plate 26, about which recess body 25 has a portion 41 projecting upwardly above the level of the bottom wall 42 of the recess and extending along the periphery of body 25 to define and contain recess 125. As seen in FIGS. 4 and 5, this upwardly projecting portion 41 of the elastomeric material extends inwardly into horizontally overlapping relation with respect to the edge of plate 26, to form an effective mechanical connection between the elastomeric material and the reinforcing plate embedded therein. A thin layer of elastomeric material may extend across and cover the upper surface of reinforcing plate 26 as represented at 43 in FIG. 4, to form the bottom wall of recess 40. Plate 26 is contained within the mold which forms body 25 at the time that the elastomeric material is molded and cured, with an adhesive being present on plate 26 acting to bond the elastomeric material to plate 26 continuously over the surface of the latter. The upper planar surfaces 37 of body 25 extends along the entire peripheral length of upwardly projecting portion 41 about recess 125, so that surface 37 may be clamped into tight engagement with the undersurface 32 of bottom wall 22 of the clip body in the connected condition of pad 24. As will be apparent from FIGS. 4 and 5 and the other figures, the edge surface 36 of the elastomeric body 25 is essentially aligned at its upper edge with the outer surface of the side and rear portions of clip body part 21 and at the front of the pad with the forward rounded portion 140 of bottom wall 22 of the clip body.

Pad 24 contains two spaced openings 44 and 45 which extend upwardly through the pad along two parallel vertical axes 46 and 47 which extend through top recess 125 and are adapted to receive the two connecting screws 27 and 28. Each of the openings 44 and 45 is formed by provision of a relatively small diameter circular hole 48 in reinforcing plate 26 of a diameter to closely receive the shank 29 of one of the screws, and a larger diameter circular hole or passage 49 formed in the elastomeric material of body 25 beneath plate 26. The enlarged diameter head portion 50 of each of the screws is received within one of the holes 49 in the elastomeric body, and bears upwardly against plate 26 about hole 48 to apply upward force to the plate as the screw is connected threadedly to the bottom wall 22 of the clip body. If desired, a thin layer 225 of the elastomeric material of body 25 may cover the undersurface of plate 26 about hole 48 and at the upper end of hole 49.

At a central location between the screw receiving openings 44 and 45, pad 24 may contain a passage 51 which serves no purpose in the FIGS. 1 through 6 form of the invention but is useful in the variational arrangement of FIGS. 7 through 10. Passage 51 may be of straight cylindrical configuration and be centered about an axis 151 which is parallel to and lies in a common vertical plane with axes 46 and 47 of screw openings 44 and 45. The passage extends through both the elastomeric material and the metal plate 26, but is preferably initially closed at its lower end by extension of a thin membrane or portion 52 of the elastomeric material of body 25 across that lower end of the passage. This membrane 52 is thin enough to be easily pierced to pass a tool upwardly therethrough in using the device on the variational clip of FIGS. 7 through 10.

The clip 15*a* of FIGS. 7 through 10 may be the same as clip 15 of the first form of the invention except that the bottom wall 22a which extends across the lower end of the main clip body part 21a is slidably removable from part 21a and the remainder of the clip by shifting bottom wall 22a from the full line connected position of FIG. 7 to the broken line detached position. The slidably removable bottom wall is of conventional construction except with regard to the application thereto of a pad 24a which may structurially be the same as the pad 24 of FIGS. 1 through 6. Bottom wall 22a of clip 15a may be retained and guided for its sliding detaching movement by providing the main body part 21a of the clip with inwardly turned horizontal flanges 53 slidably engaging opposite side edges 54 of plate 22a. A latching part 55 if pressed downwardly against bottom wall 22a by spring 19a in the clip, to hold the edges 54 of bottom wall 22a against flanges 53 as wall 22a is removed from or connected to the remainder of the clip. Latch part 55 has a downwardly projecting lug 56 which is receivable within a circular opening 57 formed in a central portion of bottom wall 22a, and which acts when so received to effectively latch or retain part 22a in its FIG. 7 full line position and against horizontal sliding detachment from the clip. The latch element is releasable by movement upwardly relative to bottom wall 22a and to the position of FIG. 9, in which lug 56 is removed from its position of reception within opening 57 and therefore no longer retains wall 22a against sliding detaching movement. As seen best in FIG. 8, the opposite edge portions 54 of bottom wall 22a of the clip are preferably offset slightly above the main central portion 58 of wall 22a.

Pad 24a is secured to wall 22a of FIGS. 7 through 10 by two screws 27a and 28a corresponding to the screws 27 and 28 of the first form of the invention and threadedly connectible into openings 30a and 31a in plate 22a. The positioning of passage 51a in pad 24a (corresponding to passage 51 of FIGS. 1 through 6) is such as to locate that passage directly beneath and in vertical alignment with opening 57 in bottom wall 22a, so that a tool 59 can be forced upwardly through the bottom elastomeric membrane 52a initially provided at the lower end of passage 51a, rupturing the membrane and enabling the tool 59 to engage lug 56 on latch part 55 to displace the latch part upwardly to the FIG. 9 released position freeing bottom wall 22a and the connected pad 24a for detaching movement.

FIGS. 11 through 13 illustrate at 60 a jig which may be utilized for drilling the screw receiving openings 30 and 31 in the bottom wall 22 of the clip of the first form of the invention, or for drilling the corresponding openings 30a and 31a in the removable bottom wall 22a of the second form of the invention. This jig 60 may be stamped from sheet metal and have a flat main planar portion 61 receivable at the underside of and adjacent either the bottom wall 22 of clip 15 or the bottom wall 22a of clip 15a. Projecting upwardly from this bottom portion 61, jig 60 has a series of locating fingers 62, 63, 64, 65, 66 and 67 spaced along the periphery of portion 61 and adapted to engage different sides of bottom wall 22 or 22a of the clip in a relation closely confining that wall within the fingers 62, 63, etc., and thereby effectively locating the jig against lateral movement in any direction relative to wall 22 or 22a. Portion 61 of the jig contains two openings 68 and 69 which are spaced apart and located in correspondence with the desired positioning of the openings 30 and 31 or 30a and 31a in wall 22 or 22a, and which are circular and of a diameter corresponding to the desired diameter of those openings 30, 31, etc., so that a drill bit 70 (FIG. 13) can extend upwardly through opening 68 or 69 in guided relation and by powered rotation while so located can drill holes 30 and 31 or 30a and 31a accurately located for reception of the mounting screws.

In applying one of the pads 24 or 24a to a gun, the user can first remove clip 15 or 15a from the handle of the gun and then place jig 60 about the lower end of the clip as illustrated in FIG. 11. The two holes 30 and 31 or 30a and 31a are then drilled in the bottom wall 22 or 22a of the clip, following which the jig can be removed and pad 24 or 24a placed against wall 22 or 22a and secured thereto by the screws 27 and 28 or 27a and 28a. The removable bottom wall 22a of the FIGS. 7 through 10 arrangement may be left in its fully connected position with respect to the upper portion of the clip during drilling of the holes in the wall 22a.

After such application of the pad to the clip, ammunition may be loaded into the clip and the clip may then be pressed upwardly into the handle of the gun by exertion of manual force upwardly against the cushioning pad. If at any time it becomes desirable that the bottom wall 22a and connected pad of the FIGS. 7 through 10 arrangement be removed from the lower end of the clip body, a user merely presses the tool 59 upwardly through passage 51a and against the latch element to release the latch element and permit sliding movement of the wall 22a and connected pad to the broken line detached position of FIG. 7.

While certain specific embodiments of the present invention have been disclosed as typical, the invention is of course not limited to these particular forms, but rather is applicable broadly to all such variations as fall within the scope of the appended claims.

We claim:

1. The combination comprising:

a hollow cartridge clip body adapted to be contained within a recess in the handle of a gun and to hold a series of rounds of ammunition and which is slidably insertible upwardly into and removable downwardly from said recess and has a bottom wall;

a cushioning pad extending across the underside of said bottom wall and including a body of resiliently deformable elastomeric material having an undersurface of said elastomeric material exposed for contact with a user's hand in pressing the clip body upwardly into said recess;

said pad including a reinforcing element stiffer than said elastomeric material and secured thereto and located above the level of said undersurface of the elastomeric material; and at least one threaded fastener extending upwardly through an aperture in said pad and connected threadedly to said bottom wall of the hollow clip body and having a head applying upward force to said reinforcing element in a relation securing said pad to the clip body.

2. The combination as recited in claim 1, in which said pad contains a recess at its upper side above the level of said reinforcing element and at which said pad is spaced from said bottom wall of the clip body, said elastomeric body having a portion extending about and defining said recess in the upper side of the pad and projecting upwardly above the level of said reinforcing element.

3. The combination as recited in claim 1, in which there are two of said threaded fasteners extending upwardly through spaced apertures in the pad and connected threadedly to said bottom wall at spaced locations.

4. The combination comprising:

a hollow cartridge clip body adapted to be contained within a recess in the handle of a gun and to hold a series of rounds of ammunition and which is slidably insertible upwardly into and removable downwardly from said recess and has a bottom wall;

a cushioning pad extending across the underside of said bottom wall and including a body of resiliently deformable elastomeric material having an undersurface of said elastomeric material and having a peripheral surface following essentially the periphery of said bottom wall;

said pad including a generally horizontal reinforcing plate stiffer than said elastomeric material and embedded therein above the level of said undersurface of the elastomeric material;

said elastomeric material containing an upwardly facing recess above the level of said reinforcing plate and at which said pad is spaced downwardly from said bottom wall of the clip body;

said elastomeric material having a portion extending about and defining said recess in the upper side of the pad and projecting upwardly above the level of said reinforcing element and engaging upwardly against said bottom wall of the clip body along the periphery of said bottom wall and said pad; and two threaded screws extending upwardly through spaced apertures in said elastomeric material and said plate and through said recess in the upper side of the pad and connected threadedly into openings in said bottom wall of the clip body and having heads applying upward force to said plate about said apertures therein in a relation securing said pad to the clip body.

5. The combination comprising:

a cartridge clip body adapted to be contained within a recess in the handle of a gun and to hold a series of rounds of ammunition and which is slidably insertible upwardly into and removable downwardly from said recess;

a bottom wall extending across the lower end of said clip body and which slidably engages the clip body for movement generally horizontally relative thereto between an active connected position of extension across the lower end of the clip and a detached position;

a cushioning pad extending across the underside of said bottom wall and secured thereto for movement therewith relative to the clip body between said connected and detached positions;

said pad including a body of resiliently deformable elastomeric material having an undersurface of said elastomeric material exposed for contact with a user's hand in pressing the clip body upwardly into said recess;

said pad including a reinforcing element stiffer than said elastomeric material and secured thereto and located above the level of said undersurface of the elastomeric material; and at least one threaded fastener extending upwardly through an aperture in said pad and connected threadedly to said bottom wall and applying upward force to said element in a relation securing said pad to said bottom wall.

6. The combination as recited in claim 5, including a latch element for releasably retaining said bottom wall in said active connected position relative to the clip body, said pad containing a passage through which a tool is insertible to a positon in which it can release said latch element to permit movement of said bottom wall to said detached position.

7. The combination as recited in claim 6, in which said passage extends through the major portion of the thickness of said elastomeric body but is closed by a thin membrane of said elastomeric material adapted to be pierced for insertion of said tool therethrough.

8. The combination as recited in claim 5, in which said bottom wall has opposite side edges which slidably engage said clip body for said movement of the bottom wall between said active and detached positions, said pad having edges which are spaced vertically from said edges of the bottom wall, said clip body having flanges slidably engaging and guiding said edges of the bottom wall and each received vertically between one of said edges of the bottom wall and a corresponding opposed edge of said pad.

9. The combination comprising:

a cartridge clip body adapted to be contained within a recess in the handle of a gun and to hold a series of rounds of ammunition and which is slidably insertible upwardly into and removable downwardly from said recess;

a bottom wall extending across the lower end of said clip body and which slidably engages the clip body for movement generally horizontally relative thereto between an active connected position of extension across the lower end of the body and a detached position;

a cushioning pad extending across the underside of said bottom wall and secured thereto for movement therewith relative to the clip body between said connected and detached positions;

said pad including a body of resiliently deformable elastomeric material having an undersurface of said elastomeric material exposed for contact with a user's hand in pressing the clip body upwardly into said recess and having an upper surface through which upward force is applied to said bottom wall of the clip body;

said pad including a metal reinforcing plate stiffer than said elastomeric material and embedded therein and located above the level of said undersurface of the elastomeric material and beneath the level of said upper surface thereof;

a spring pressed latching plate above said bottom wall and having a lug projecting downwardly into an opening in said bottom wall in a relation latching the bottom wall in said active position and adapted to be released by pressing said lug upwardly relative to the bottom wall; and two threaded screws extending upwardly through spaced apertures in said elastomeric material and said reinforcing plate of the pad and connected threadedly to said bottom wall at spaced locations;

said pad containing a passage at a location between said spaced apertures and vertically opposite said lug and through which a tool is insertible upwardly to press the lug upwardly and thereby release said bottom wall for sliding movement to said detached position.

10. The combination as recited in claim 9, in which said passage extends through the major portion of the thickness of said elastomeric body but is closed by a thin membrane of said elastomeric material adapted to be pierced for insertion of said tool therethrough, said bottom wall having opposite side edges which slidably engage said clip body for said movement of the bottom wall between said active and detached positions, said pad having edges which are spaced vertically from said edges of the bottom wall, said clip body having flanges slidably engaging and guiding said edges of the bottom wall and each received vertically between one of said edges of the bottom wall and a corresponding opposed edge of said pad.

11. For use with a hollow cartridge clip body adapted to be contained within a recess in the handle of a gun and to hold a series of rounds of ammunition and which is slidably insertible upwardly into and removable downwardly from said recess and which has a bottom wall, the combination comprising:

a cushioning pad adapted to extend across the underside of said bottom wall and including a body of resiliently deformable elastomeric material having an undersurface of said elastomeric material exposed for contact with a user's hand in pressing the clip body upwardly into said recess;

said pad including a reinforcing element stiffer than said elastomeric material and secured thereto and located above the level of said undersurface of the elastomeric material;

said elastomeric material and said reinforcing element of said pad containing apertures extending upwardly therethrough; and at least one threaded fastener adapted to extend upwardly through said apertures in the elastomeric material and reinforcing element and to be connected threadedly to said bottom wall of the clip body and having a head adapted to apply upward force to said reinforcing element about said aperture therein in a relation securing said pad to the clip body.

12. The combination as recited in claim 11, in which said pad contains a recess at its upper side above the level of said reinforcing element and at which said pad is spaced from said bottom wall of the clip body, said elastomeric body having a portion extending about and defining said recess in the upper side of the pad and projecting upwardly above the level of said receiving element.

13. The combination as recited in claim 11, in which there are two of said threaded fasteners adapted to extend upwardly through spaced apertures in the pad and to be connected threadedly to said bottom wall at spaced locations.

14. The combination as recited in claim 11, in which said pad contains a passage located to pass a tool upwardly through the pad to a position for releasing a latch element which retains said bottom wall against lateral detaching movement relative to said clip body.

15. The combination as recited in claim 14, in which said pad has a thin diaphragm of said elastomeric material disposed across said passage and adapted to be pierced to pass a tool upwardly therethrough.

16. For use with a hollow cartridge clip body adapted to be contained within a recess in the handle of a gun and to hold a series of rounds of ammunition and which is slidably insertible upwardly into and removable downwardly from said recess and which has a bottom wall, the combination comprising:

a cushioning pad adapted to extend across the underside of said bottom wall and including a body of resiliently deformable elastomeric material having an undersurface of said elastomeric material exposed for contact with a user's hand in pressing the clip body upwardly into said recess;

said pad including a generally horizontal metal reinforcing plate stiffer than said elastomeric material and embedded therein above the level of said undersurface of the elastomeric material;

said elastomeric material containing an upwardly facing recess above the level of said reinforcing plate and having a portion extending about and defining said recess in the upper side of the pad and projecting upwardly above the level of said reinforcing element;

said pad containing two spaced apertures extending upwardly through both the elastomeric material and reinforcing plate of the pad at the location of said recess; and two threaded screws adapted to extend upwardly through said apertures in the pad and through said recess and to be connected to said bottom wall of the clip body and having heads adapted to apply upward force to said plate about said apertures in a relation securing said pad to the clip body.

17. The combination as recited in claim 16, in which said pad contains a passage at a location between said spaced apertures and through which a tool is insertible upwardly to release a latch element retaining said bottom wall against detaching movement.

18. The combination comprising:

a cartridge clip body adapted to be contained within a recess in the handle of a gun and to hold a series of rounds of ammunition and which is slidably insertible upwardly into and removable downwardly from said recess;

a bottom wall extending across the lower end of said clip body and which slidably engages the clip body for movement generally horizontally relative thereto between an active connected position of extension across the lower end of the body and a detached position;

a latch element operable to releasably retain said bottom wall against movement from said active position; and a cushioning pad formed at least in part of resiliently deformable elastomeric material and extending across the underside of said bottom wall and secured thereto for movement therewith relative to the clip body between said connected and detached positions;

said pad containing a passage through which a tool can be inserted upwardly to a position in which it can release said latch element and permit detaching movement of said bottom wall and pad.

19. The combination as recited in claim 18, in which said pad has a thin membrane of said elastomeric material disposed across said passage and which can be pierced to pass said tool upwardly therethrough.

* * * * *